US005462648A

United States Patent [19]

Wakabayashi et al.

[11] Patent Number: 5,462,648

[45] Date of Patent: Oct. 31, 1995

[54] METHOD FOR FABRICATING A METAL MEMBER HAVING A PLURALITY OF FINE HOLES

[75] Inventors: Kimihiro Wakabayashi; Noriyuki Nebashi, both of Ebina, Japan

[73] Assignee: Fuji Xerox Co., Ltd., Tokyo, Japan

[21] Appl. No.: 272,429

[22] Filed: Jul. 11, 1994

[30] Foreign Application Priority Data

Sep. 27, 1993 [JP] Japan ..... 5-239382

[51] Int. Cl.[6] ..... C25D 1/08

[52] U.S. Cl. ..... 205/75

[58] Field of Search ..... 205/75, 67, 73, 205/70

[56] References Cited

U.S. PATENT DOCUMENTS

| | | | |
|---|---|---|---|
| 3,046,202 | 7/1962 | Horner | 205/75 |
| 4,184,925 | 1/1980 | Kenworthy | 205/75 |
| 4,246,076 | 1/1981 | Gardner | 205/75 |
| 4,971,665 | 11/1990 | Sexton | 205/75 |

FOREIGN PATENT DOCUMENTS

| | | |
|---|---|---|
| 58-13355 | 3/1983 | Japan . |
| 1-105749 | 4/1989 | Japan . |

*Primary Examiner*—John Niebling
*Assistant Examiner*—Brendan Mee
*Attorney, Agent, or Firm*—Oliff & Berridge

[57] ABSTRACT

A method for fabricating a metal member having a plurality or multitude of fine holes comprises forming a repeatedly usable master which includes a conductive substrate and non-conductive portions used to form the fine holes and fixedly deposited on the conductive substrate, subjecting the master to electrodeposition to form an electrodeposition film which has non-electrodeposited fine holes in position corresponding to the non-conductive portions, and separating the electrodeposition film from the master. In the master formation step, the non-conductive portions are so formed to have projections from the surface of the conductive substrate. The electrodeposition is effected so that the electrodeposition film is deposited about the side surfaces of each projection as exposing at least a top of the projection. The fine holes of the separated electrodeposition film have invariably a constant dimensional accuracy without suffering any influence of the electrodeposition conditions. The formation density of the fine holes is free of any limitation as will be caused by the thickness of the electrodeposition film.

10 Claims, 7 Drawing Sheets

METHOD FOR FABRICATING A METAL MEMBER HAVING A PLURALITY OF FINE HOLES

BACKGROUND OF THE INVENTION

1. Field of the Invention

This invention relates to a method for fabricating a metal member having a plurality of fine holes.

2. Description of the Prior Art

For the fabrication of a metal sheet having a multitude of fine holes at high precision in the order of micrometers, it is the usual practice to adopt etching methods which make use of photofabrication techniques.

According to the etching method, for example, a photosensitive resin layer called a photoresist is applied entirely on one side of a metal sheet substrate on which fine holes are to be formed. The resin layer is subjected to exposure to light and development according to a photographic process, thereby removing the resin layer at portions where the fine holes are to be formed, thereby forming openings in the resin layer. The metal sheet is etched with a liquid etchant through the openings to make holes corresponding to the openings. Thus, the metal sheet having a multitude of fine holes can be fabricated.

In the method for fabricating a metal sheet having a multitude of fine holes according to the etching technique, however, the degree of etching may differ depending on the uniformity in composition of the metal sheet substrate. This will result in the variation in diameter of the fine holes being made, with the attendant drawback that desired fine holes cannot be formed with high precision.

To overcome the drawback, there has been proposed a technique of fabricating a metal sheet having a multitude of fine holes using an electrodeposition method which ensures high processing precision (Japanese Patent Publication No. 58-13355).

More particularly, according to this technique, a multitude of non-conductive portions 101 used to form fine holes are formed, as shown in FIG. 7*a* on a conductive substrate 100 such as a stainless steel sheet to make a master 102. Then, electrodeposition such as of nickel is performed on the surface of the master 102, thereby forming on the master 102 an electrodeposition coating 104 having a hole 103 as a non-electrodeposited portion which is free of any electrodeposit at the inner periphery of the non-conductive portion 101. This is shown in FIG. 7*b*. The electrodeposition coating 104 is separated from the master 102 to obtain a metal sheet 106 having fine holes 105 (103) as shown in FIGS. 7*c* and 8.

However, this method is disadvantageous in that the non-conductive portions 101 on the master 102 are formed according to the photoresist method and are thus weak in the strength of bonding to the conductive substrate 100. For instance, when the electrodeposition coating 104 is separated from the master 102, part of the non-conductive portions 101 may also be separated from the conductive substrate 100. Whenever the separation takes place, it becomes necessary to re-fabricate the master 102. This will undesirably lead to poor productivity, thus presenting the problem of increasing production costs. Moreover, whenever the master is re-fabricated as a fresh one, the patterns of the non-conductive portions on the respective masters are minutely changed. A problem arises in that the dimensional precision of the holes of individual metal sheets vary among the sheets.

To solve the above problem, we have already proposed a novel fabrication technique as set forth in Japanese Laid-open Patent Application No. 1-105749.

According to this fabrication method shown in FIGS. 9*a* to 9*c*, a conductive substrate 200 is formed with through-holes 201 such as by electrical discharge machining as shown in FIG. 9*a*. The through-holes 201 are, respectively, filled with a non-conductive material 202 to provide non-conductive portions 203 with which fine holes are formed, thereby forming a master 204 as shown in FIG. 9*b*. The master 204 is then subjected to electrodeposition on one side thereof to form an electrodeposition film 206 having holes 205 which are each composed of a non-electrodeposited portion corresponding to individual non-conductive portion 203 as shown in FIG. 9*c*. Finally, the electrodeposition film 206 is separated from the master 204 to obtain a metal sheet 106 having fine holes 105 (205) as shown in FIG. 8. In FIGS. 9*a* to 9*c*, reference numeral 207 indicates an electrode and reference numeral 208 indicates a backup plate.

The fabrication method is advantageous in that the non-conductive portions 203 are fixedly deposited on the conductive substrate 200, not permitting even a part of the non-conductive portions to be separated at the time of the separation of the electrodeposition film. In addition, because the master 204 can be repeatedly used, metal sheets each having fine holes at high precision can be readily fabricated in an efficient manner.

However, the fabrication method which makes use of the above repeatedly usable type of master has the following problems.

In the fabrication method, as shown in FIG. 10, the non-conductive portion 203 is formed at the same level as the conductive substrate 200 of the master 204. The electrodeposition film 206 is formed as slightly overlapped at the periphery of the non-conductive portion 203. Accordingly, the diameter, r, of the actually formed fine hole 105 (205) is a value which is obtained by subtracting the length, x, of the overlapped electrodeposition film 206 from the diameter, d, of the through-hole 201 with which the non-conductive portion 203 is formed. More specifically, the diameter, r, of the fine hole 105 is determined depending on the overlapped length of the electrodeposition film 206. Because the overlapped length varies depending on the electrodeposition time and electrodeposition conditions, the diameters, r, of the fine holes 105 vary, depending on the variation in the overlap length, in one metal sheet or among the repeatedly fabricated metal sheets. This presents the problem that the accuracy of the fine holes lowers according to the state of the electrodeposited film, i.e. the variation in the overlapped total length.

Although the electrodeposition film 206 can be controlled to an extent by controlling electrodeposition conditions with respect to the ratio between the film-forming speed along the direction of thickness and the film-forming speed (overlap length) along the lateral direction, the ratio takes a value of approximately 1. If the thickness of the electrodeposition film (or thickness of the metal sheet 106) is increased, it should be taken into account that the overlap length also increases substantially at the same rate as the film thickness. This means that for the formation of fine holes 205 with the same diameter, the distance between adjacent fine holes has to be increased at the same time. Eventually, the thickness of the electrodeposition film undesirably places a limitation on the number of the fine holes (i.e. hole-formation density) to be formed.

SUMMARY OF THE INVENTION

An object of the invention is to provide a method for fabricating a metal member having a plurality of or a multitude of fine holes which overcomes the problems involved in the prior art.

Another object of the invention is to provide a method for fabricating a metal member having a plurality of fine holes which are invariably constant in dimensional accuracy when formed under varying electrodeposition conditions.

A further object of the invention is to provide a method for fabricating a metal member having a plurality of fine holes wherein the formation density of the fine holes is irrespective of the thickness of an electrodeposition film and is thus not limited.

The above objects can be achieved, according to the invention, by a method for fabricating a metal member having a plurality of fine holes, the method comprising the steps of forming a repeatedly usable master which includes a conductive substrate and non-conductive portions used to form fine holes and integrally combined with the conductive substrate, forming an electrodeposition film by subjecting one side of the master to electrodeposition to form an electrodeposition film which has a plurality of non-electrodeposited holes corresponding in position to the non-conductive portions, and separating the electrodeposition film from the master to obtain a metal member having the multitude of fine holes, wherein the non-conductive portions of the master, respectively, consist of raised non-conductive portions each having a projection from the surface of the conductive substrate and the electrodeposition is so performed that the electrodeposition film is deposited about individual projections.

The raised non-conductive portions have the so-called shaping function so that the shape of finally formed fine holes is the same as the shape (especially, profile shape) as of the portion projected or the projection from the conductive substrate surface. Accordingly, if the projected non-conductive portions (which correspond, in fact, to through-holes or recesses formed in the conductive substrate) are properly controlled with respect to their shape and size, there can be formed fine holes with desired shape and size.

DETAILED DESCRIPTION AND EMBODIMENTS OF THE INVENTION

Figure 1A:
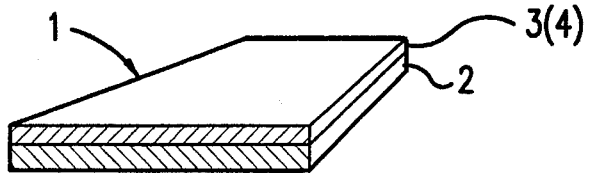
FIGS. 1*a* to 1*f* are, respectively, illustrative views showing the steps of a fabrication method according to one embodiment of the invention.

The repeatedly usable master used in the method of the invention is constituted of the conductive substrate having through-holes or recesses in which non-conductive portions are to be formed, and raised non-conductive portions which are filled in the through-holes or recesses as having projections from the through-holes or recesses above the substrate surface continuously. thereby forming raised non-conductive portions. The non-conductive portions are, of course, made of non-conductive materials as will be described hereinafter.

The thus arranged master should preferably be formed by providing a conductive substrate which has a double-layer structure including a removable layer, forming through-holes or recesses in the conductive substrate, filling a curable non-conductive material in the through-holes or recesses, curing the curable non-conductive material, removing the removable layer from the conductive substrate so that the cured material is partially projected from the substrate surface at a length corresponding to the thickness of the removable layer to form raised non-conductive portions.

The conductive substrate composed of the double-layer structure with a removable layer includes a substrate to be left such as, for example, a stainless steel sheet, a copper sheet, a nickel sheet or the like, and a metal or alloy sheet built up on the substrate and capable of being removed by selective etching or peeling off after filling and curing of non-conductive materials. The non-conductive materials may be epoxy resins, acrylic resins and the like curable materials.

The conductive substrate is formed with through-holes or recesses according to electrical discharge machining or etching. If recesses are formed, they should have a depth which is greater than the thickness of the removable layer of the conductive substrate.

In this condition, the conductive substrate is electrodeposited or plated with metals. The electrodeposition conditions including a concentration of a solution in a plating tank, a current density and the like should be properly controlled depending on the thickness of a metal member to be fabricated. The electrodeposited or plated film is fundamentally formed as deposited about the side surfaces of each projection of the raised non-conductive portions. If necessary, the projection may be deposited so that the upper surface thereof is slightly covered or overlapped with the film. The electrodeposition materials or metals include nickel, copper, iron, cobalt, gold, silver and the like.

In order to facilitate release or separation of the electrodeposition film from the master in the separation step of the method of the invention, the projections of the raised non-conductive portions may be slightly converged in shape or may have a so-called convergently tapered shape. Alternatively, the conductive substrate may be subjected to release treatment on the surfaces of the substrate contacting the electrodeposition film by immersion in a solution of 1 to 10 g/liter of potassium bichromate at normal temperatures for 20 to 60 seconds.

The resultant metal member having fine holes which is obtained according to the method of the invention is generally in the form of a sheet or plate but should not be limited thereto. More particularly, any form may be used provided that the formation of the electrodeposition film on the conductive substrate or the separation of the film from the substrate is possible. According to the method of the invention, fine holes having a size or diameter of from 5 to 100 μm can be formed in high accuracy and stably. Needless to say, fine holes with larger diameters can be formed, if required.

The metal member having such fine holes as set out hereinbefore has wide utility in various technical fields. For instance, the member can be used as nozzle members for jetting an ink in inkjet recording heads, nozzle members for jetting an ink in electrostatic recording heads for recording images by utilization of ions, metallic filters and the like.

According to the method of the invention, a master is formed in the master formation step wherein non-conductive portions consist of raised non-conductive portions as projected from the surface of the conductive substrate and an electrodeposition film is formed about the side surfaces of the respective projections of the non-conductive portions in the electrodeposition film formation step. The resultant metal member has fine holes whose diameter and inner surface profile are determined depending on the diameter and outer surface profile of the respective projections of the raised non-conductive portions. This invariably ensures the stable dimensional accuracy of the holes without being influenced by the state of the electrodeposition film. Moreover, for setting the pitches between adjacent holes, it is not necessary to take the overlap quantity or length of the electrodeposition film into consideration, unlike the prior art methods. The fine holes can be formed at a desired density without limitation caused by the thickness of the electrodeposition film, ensuring a high density of the fine holes being formed.

Since a repeatedly usable master is used, metal members having highly accurate fine holes can be mass-produced in an efficient manner. The raised non-conductive portions of the master are fixedly formed on the conductive substrate, so that there is little chance that non-conductive material used to make the non-conductive portions is left within the fine holes when released or separated.

The present invention is more particularly described by way of examples with reference to the accompanying drawings, which should not be construed as limiting the invention thereto.

[EXAMPLE 1]

First, there was made a master which was used to fabricate a 30 μm thick metal sheet having one hundred fine holes with a diameter of 60 μm and a pitch between adjacent holes of 60 μm.

Figure 1B:
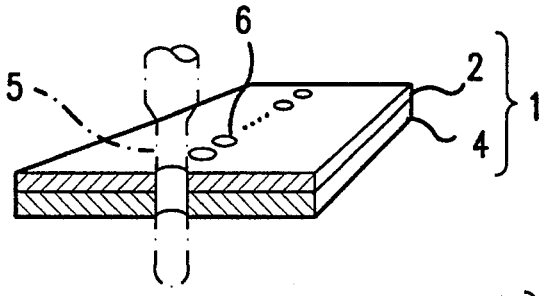

More particularly, as shown in FIGS. 1*a* and 1*b*, there was provided as a conductive substrate 1 a clad foil having a 30 μm stainless steel (SUS304) sheet 2 built up thereon with a removable layer 3 made of a 50 μm thick aluminum sheet 4. The conductive substrate 1 was processed with an electrical discharge machine having a CR oscillating circuit in such a way that while an electrode 5 of the machine was rotating, one hundred through-holes 6 having a diameter of 60 μm and used to form non-conductive portions were made at pitches of 60 μm.

The diameter and pitches of the through-holes 6 should be basically coincident with the diameter and pitches of desired fine holes. In this example, the electrode 5 of the discharge machine was applied for the discharge machining from the side of the layer 2, which was to be left as the master, and was forced through the removable layer 4. The through-holes 6 were made as being so tapered that the hole diameter at the surface of the stainless steel sheet 2 from which the discharge machining was initiated was gradually increased by about 1 to 3 μm over the hole diameter at the surface of the aluminum sheet 4.

Subsequently, the conductive substrate 1 having the through-holes 6 was immersed in a non-cured epoxy resin contained in a container and thus the through-holes 6 were filled with the epoxy resin, followed by placing the conductive substrate 1 on a flat sheet 8 such that the stainless steel sheet 2 was in face-to-face relation with the flat sheet 8 thereby ensuring a flat surface of the epoxy resin. Then, the epoxy resin was cured.

Figure 1C:
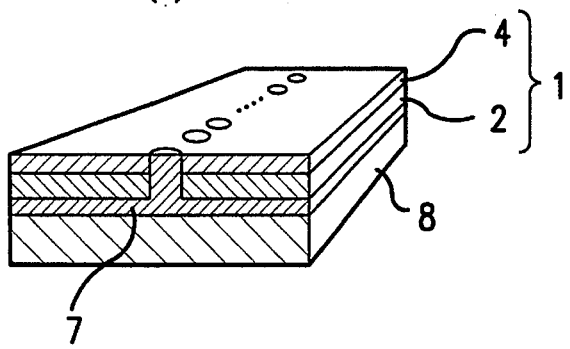
Figure 1D:
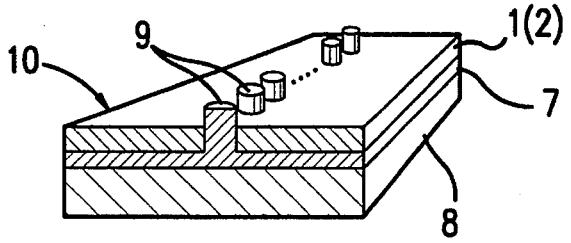

After completion of the curing of the epoxy resin, the aluminum sheet 4 surface of the conductive substrate 1 was polished to remove the cured epoxy resin from the surface but to leave the resin in the through-holes 6 as they are. This is particularly shown in FIG. 1*c*. The thus polished conductive substrate 1 was immersed in an 1N sodium hydroxide solution to selectively etch and remove the aluminum sheet 4 alone which was the removable layer 3 of the conductive substrate 1. Thus, as shown in FIG. 1*d*, there was obtained a master 10 which had raised non-conductive portions 9 which had, respectively, projections or portions projected from the surface of the stainless steel sheet 2 of the conductive substrate 1.

The master 10 was immersed in a plating bath containing nickel sulfamate and subjected to electrodeposition under conditions of a current density of $2A/dm^2$ for 72 minutes. As a result, an electrodeposition or plated film 11 having a thickness of 30 μm was formed on the master 10 as deposited about individual projections of the non-conductive portions 9. This is particularly shown in FIG. 1*e*.

Figure 1E:
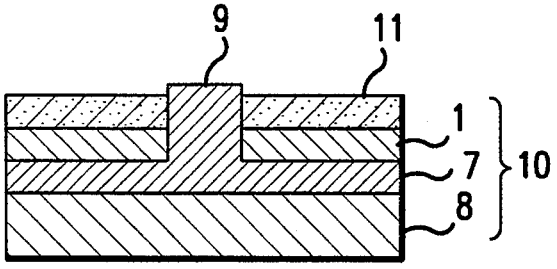
Figure 1F:
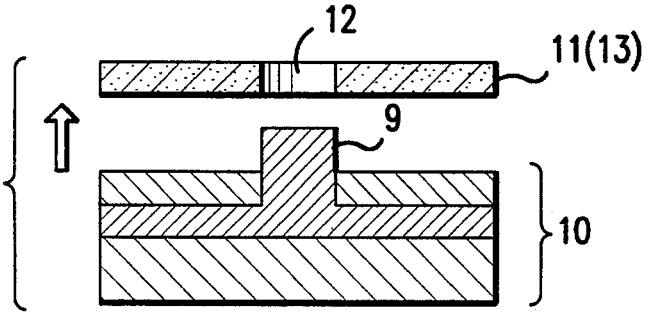
Figure 3:
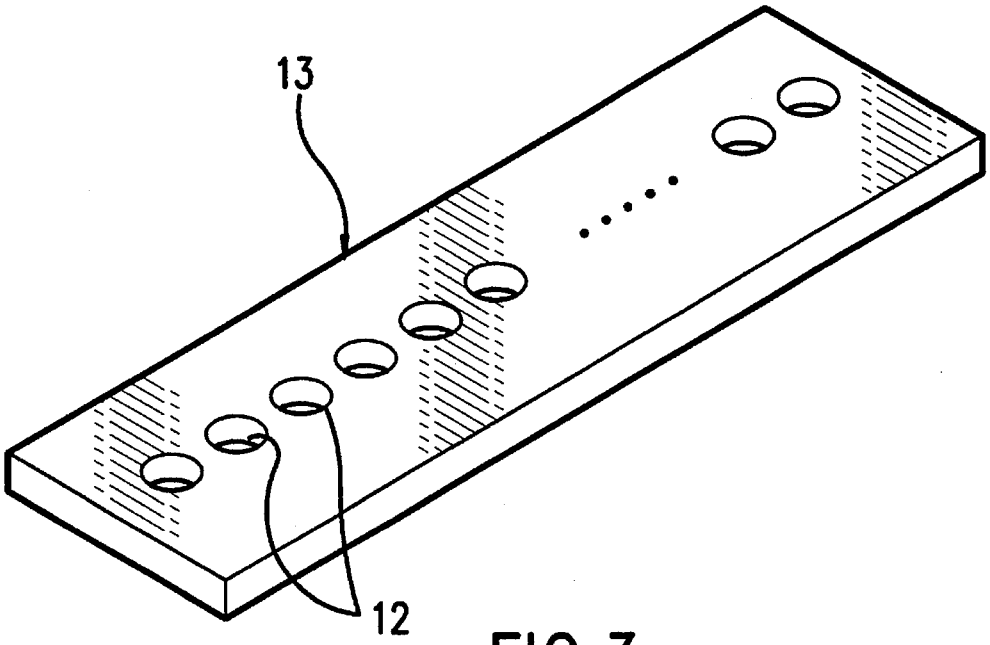
FIG. 3 is a perspective view of a metal sheet having fine holes obtained according to the method of the invention.

Finally, as shown in FIG. 1*f*, the electrodeposition film 11 was separated from the master 10 to obtain, as shown in FIG. 3, a 30 μm thick electrodeposition sheet 13 having 100 fine through-holes 12. The fine through-holes 12 of the electrodeposition sheet 13 had, respectively, a hole diameter of 60 μm and hole pitches of 60 μm.

In this example, the electrodeposition film 11 is formed as deposited about the side faces of individual projections of the raised non-conductive portions 9 as shown in FIG. 1*e*. The diameter of each fine hole 12 of the metal sheet 13 is invariably regulated by the diameter of the projections of the non-conductive portions. It is thus unnecessary to take the overlap length or quantity of electrodeposition film into consideration, ensuring mass production of the metal sheet 13 having the fine holes 12 with their dimensional accuracy undergoing little variation.

Figure 2:
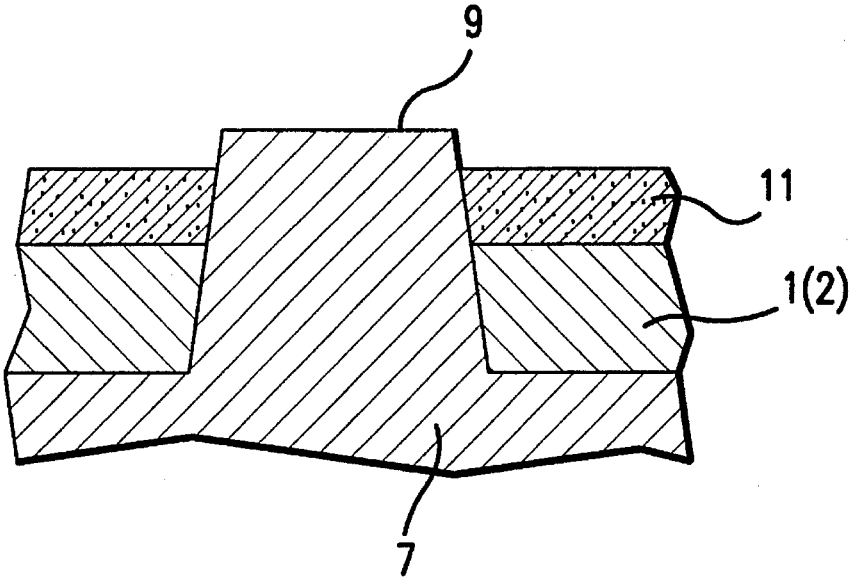
FIG. 2 is an enlarged, sectional view showing an essential part of an electrodeposition film formed on a master having a raised conductive portion.

Since each through-hole 6 is made as tapered, the projection of the non-conductive portion 9 of the master 10 is also tapered convergently as is particularly shown in FIG. 2. This is advantageous in that when separated from the master 10, the electrodeposition film 11 can be more readily taken off from the projections of the non-conductive portions 9, resulting in easier separation of the film 11 from the master 10. Another advantage is that such a tapered projection is more unlikely to suffer wear or breakage at the time of the separation and that the wear or breakage as would otherwise occur on repeated use of the master can be effectively prevented. In addition, the non-conductive material constituting the non-conductive portions 9 is not left in the respective fine holes 12 of the metal sheet 13 obtained after separation from the master 10. This permits omission or simplification of an additional step of washing the metal sheet 13 after separation.

The degree of tapering can be appropriately controlled by controlling the discharge machining conditions and by properly selecting the type of machining electrode while taking the kind of material for the conductive substrate and the machining thickness into account. In order to obtain an intended diameter of the fine holes, it is preferred to determine the diameter of the machining electrode while keeping in view the degree of taper. Of course, the projections which are not tapered in a manner as set out hereinabove may also be used in the practice of the invention.

The layer member of the conductive substrate 1 which is actually used as a master consists of the stainless steel sheet 2 and thus exhibits good releasability. No specific release treatment is necessary. It will be noted that if the electrodeposition film is liable to release during the course of the electrodeposition film formation step owing to the great release properties of the sheet 2, the stainless steel sheet may be roughened on the surface thereof either mechanically such as by sand paper polishing or chemically such as by application of hydrochloric acid or the like, thereby enhancing adhesion to the electrodeposition film.

The non-conductive portions 9 of the master 10 are embedded in the respective through-holes 6 of the conductive substrate 1 except for the projections. In this condition, when the electrodeposition film 11 is removed or released from the master 10, the raised non-conductive portions 9 does not separate from the conductive substrate 1. Accordingly, the master 10 can be repeatedly used, permitting mass production of the metal sheets 13 having the fine holes 12 in high accuracy.

[EXAMPLE 2]

The general procedure of this example is substantially the same as that of Example 1 except that the through-holes of the conductive substrate are made by etching in the master formation step.

Figure 4A:
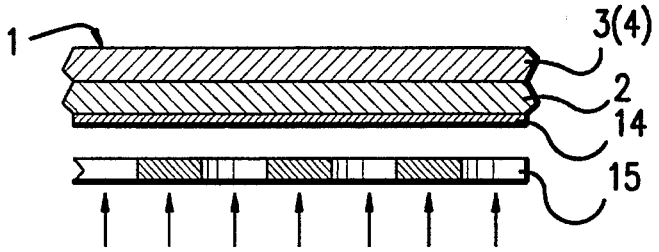
FIGS. 4*a* to 4*g* are, respectively, illustrative views showing the steps of a fabrication method according to another embodiment of, the invention.
Figure 4B:
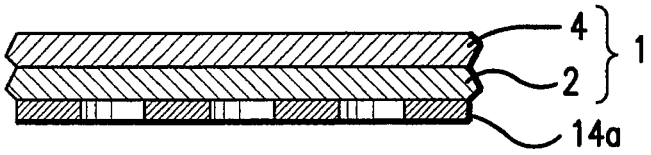

More particularly, as shown in FIG. 4*a*, a photoresist 14 (commercially available from Fuji Pharm. Ind. Co., Ltd. under the designation of FSR) was uniformly applied onto one side of a stainless steel 2 of a conductive substrate 1, followed by pattern exposure through a photomask 15 from the side of the photoresist 14. The resist film where not exposed was removed by dissolution to form a patternized photoresist 14*a* corresponding to a through-holes pattern with which non-conductive portions were to be formed. This is shown in FIG. 4*b*.

Figure 4C:
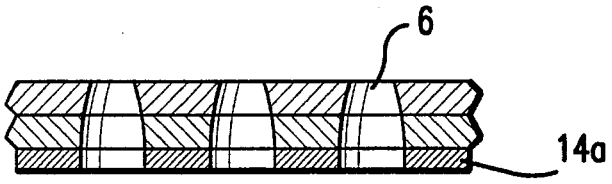

Thereafter, the photoresist pattern-bearing substrate 1 was immersed in an etching solution of ferric chloride ($FeCl_3$) and etched. By this, the etching proceeded from the side of the stainless steel sheet 2 of the conductive substrate 1 and was continued until through-holes 6 with a diameter of 60 μm were made for the formation of non-conductive portions as shown in FIG. 4*c*.

It is preferred that in order to permit the etching to proceed only from the one side (i.e. the side of the stainless steel sheet 2) of the substrate 1 thereby making the through-holes 6, for example, the photoresist is formed on the entire surfaces of the conductive substrate 1 and the pattern exposure is effected only from the side of the stainless steel sheet 2. This means that the aluminum sheet 4 at the opposite side is not exposed to light and thus, the resist remains as it is on the entire opposite side. In this condition, the conductive substrate 1 is subjected to etching. Besides, the entire side of the aluminum sheet 4 may be covered with a removable masking material such as a self-adhesive tape.

Figure 4D:
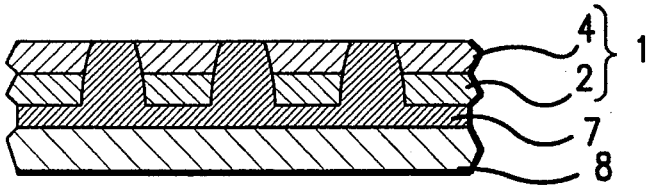
Figure 4E:
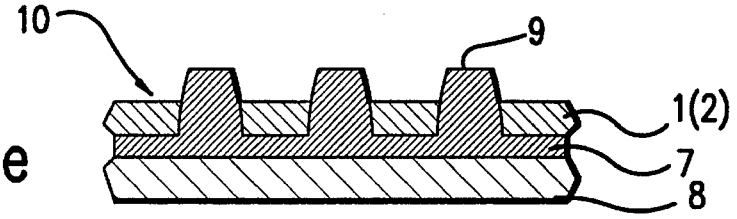

Then, the procedure of Example 1 was repeated. More specifically, the conductive substrate 1 having the through-holes 6 made according to an etching method was immersed in an uncured epoxy resin contained in a container, by which the through-holes 6 were filled up with the epoxy resin. At the same time, the conductive substrate 1 was placed and pressed down on a flat plate 8 at the side of the stainless steel sheet 2 to flatten the epoxy resin, followed by curing the epoxy resin. After completion of the curing of the epoxy resin, the conductive substrate 1 was polished on the surface of the aluminum sheet 4 to remove the epoxy resin therefrom while leaving the epoxy resin only in the respective through-holes 6 as shown in FIG. 4*d*. The thus polished substrate 1 was immersed in a 1N sodium hydroxide solution to selectively etch the aluminum sheet 4 alone from the conductive substrate 1 thereby removing the removable layer 3. Eventually, as shown in FIG. 4*e*, there was obtained a master 10 which was formed with raised non-conductive portions 9 having projections projected from the surface of the stainless steel sheet 2 of the conductive substrate 1.

Where the etching technique is adopted for making the through-holes 6 of the formation of the non-conductive portions as in this example, there can be simply and readily formed such a master which is used to make a metal sheet having a plurality of fine holes, say, several tens thousands of fine holes.

Figure 4F:
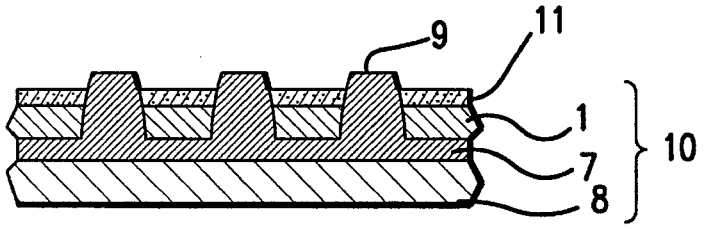
Figure 4G:
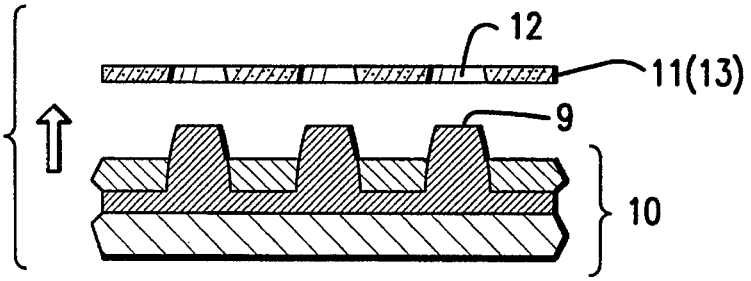

The thus formed master 10 was formed thereon with an electrodeposition film 11 in the same manner as in Example 1 as shown in FIGS. 4*f* and 4*g*, followed by separation of the film 11 from the master 10 thereby obtaining a metal sheet 13 having fine holes 12 as in Example 1.

In this example, as shown in FIG. 4*f*, the electrodeposition film 11 is formed as deposited about the side surfaces of the respective projections of the non-conductive portions 9. The resultant metal sheet 13 has the fine holes 12 whose diameter is invariably regulated by the diameter of the projections of the non-conductive portions. It is not necessary to take into consideration the length or quantity of the overlap of the electrodeposition film. This permits the fabrication of a number of the metal sheets 13 having the fine holes 12 whose dimensional accuracy is not varied in each sheet or among the sheets 13.

In addition, the etching is effected on only one side of the conductive substrate 1 so that the through-holes 6 can be formed as tapered. Like Example 1, the projections of the raised non-conductive portions 9 are neither separated nor broken down, permitting the electrodeposition film 11 to be readily released or separated from the master 10.

[EXAMPLE 3]

In this example, the general procedure of Example 1 was repeated except that the electrodeposition (or plated) film was grown up through a multi-stage procedure to make a thick film.

Figure 5A:
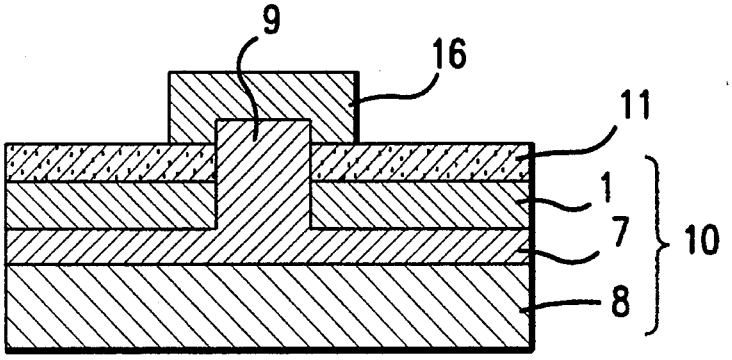
FIGS. 5*a* to 5*d* are, respectively, illustrative views showing the steps of a fabrication method according to a further embodiment of the invention.
Figure 5B:
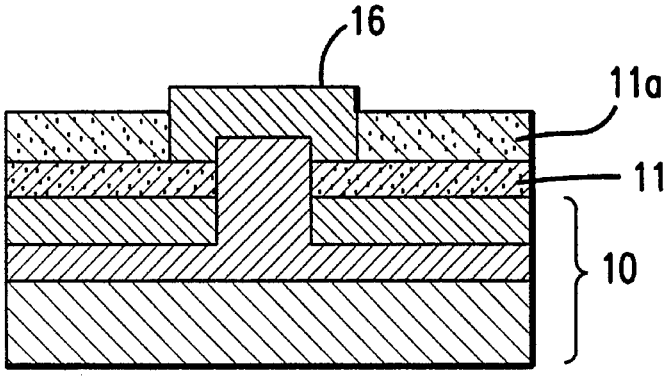

In this example, the master of FIG. 1*e* obtained after completion of the electrodeposition film-forming step of Example 1 was further applied with a non-conductive material 16, such as a photoresist (OFPR-2,35CP available from Tokyo Oka Chem. Ind. Co., Ltd.), at about the individual raised non-conductive portions 9 and their neighbors as shown in FIG. 5*a*. After completion of the application, the photoresist 16 was exposed to light and developed as usual. Thereafter, electrodeposition was carried out under the same conditions as in Example 1 to grow up a second electrodeposition film 11*a* as shown in FIG. 5*b*.

Figure 5C:
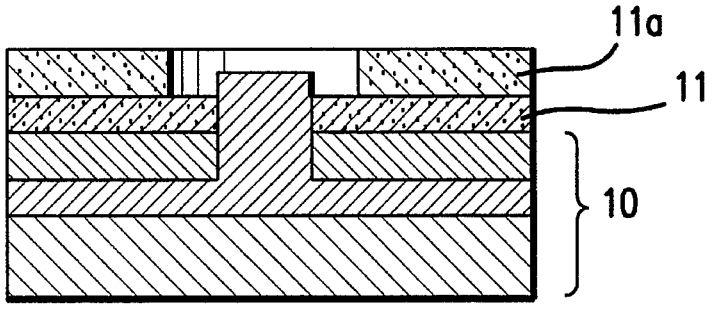
Figure 5D:
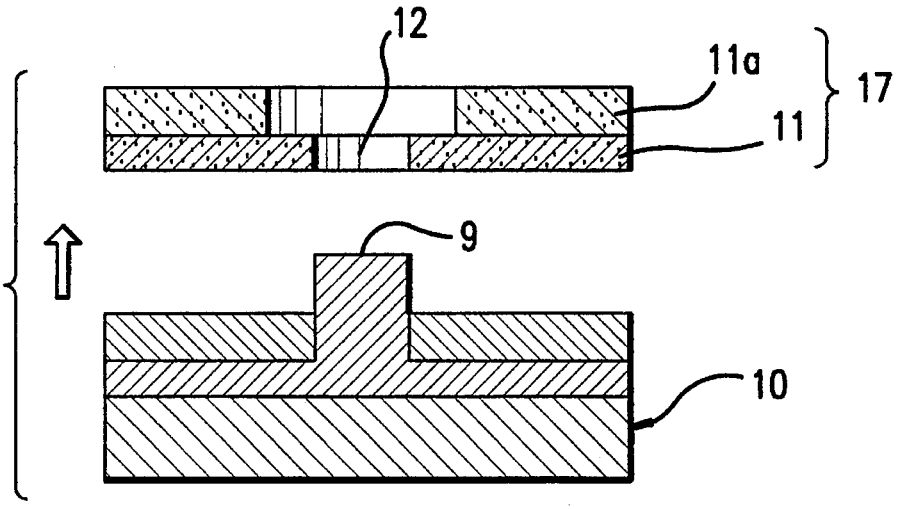

Subsequently, as shown in FIG. 5*c*, the non-conductive material layer 16 was removed from the second electrodeposition film 11*a*, followed by separation of the electrodeposition film consisting integrally of the electrodeposition film 11 and the second electrodeposition film 11*a* from the master 10. As a result, there was obtained a metal sheet 17 having a thickness which was three times as large as that of the metal sheet 13 of Example 1 as is particularly shown in FIG. 5*d*.

The metal sheet 17 having the fine holes 12 which is obtained by multi-stage growth of the electrodeposition film as in this example is so thick that it has high rigidity, making it easy to handle. Where the thick metal sheet 17 is fabricated, the fine holes 12 of the metal sheet 17 are regulated in the diameter by the size of the projections of the raised non-conductive portions 9, resulting in the fine holes which have little or no variation of the dimensional accuracy and thus become highly accurate.

[EXAMPLE 4]

In this example, the general procedure of Example 1 was repeated except that the conductive substrate was formed with recesses instead of the through-holes in the master formation step.

Figure 6A:
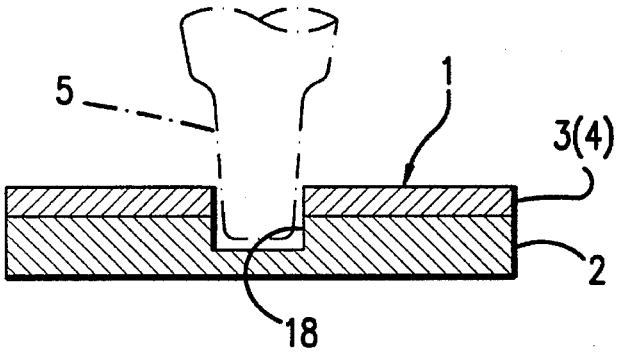
FIGS. 6*a* to 6*f* are, respectively, illustrative views showing the steps of a fabrication method according to a still further embodiment of the invention.

In this example, as shown in FIG. 6*a*, a clad foil which had a 1 mm thick stainless steel (SUS304) sheet 2 and a 50 μm thick aluminum sheet 4 serving as a removable layer 3 and built up on the steel sheet 2 was provided as a conductive substrate 1. The substrate 1 was formed at the side of the aluminum sheet 4 with one hundred recesses 18, which were used to form non-conductive portions and each had a depth of 300 μm and a diameter of 60 μm, at pitches of 60 μm while rotating electrodes 5 of a discharge machine equipped with a CR oscillation circuit.

Figure 6B:
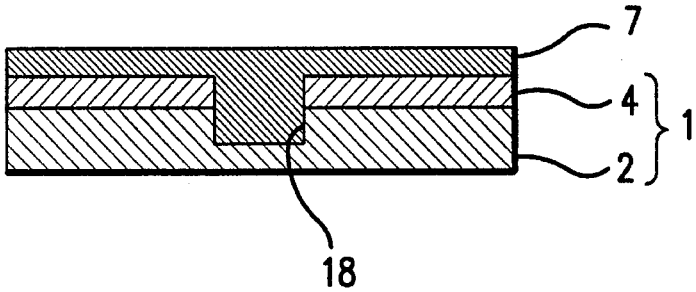

The recess 18-bearing conductive substrate 1 was immersed in an uncured epoxy resin, which is a non-conductive material 7, contained in a container and filled in the recesses 18 with the epoxy resin, followed by curing the epoxy resin as shown in FIG. 6*b*.

Figure 6C:
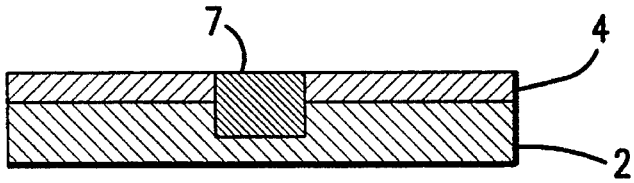
Figure 6D:
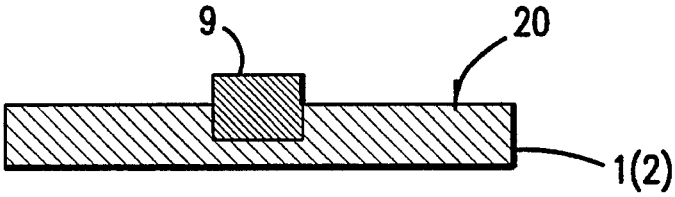

Example 1 was then repeated with respect to the subsequent procedure. More particularly, the conductive substrate 1 was polished on the surface of the aluminum sheet 4 to remove additional epoxy resin except for the resin filled in the respective recesses 18 as shown in FIG. 6*c*. The thus polished substrate 1 was immersed in a 1N sodium hydroxide solution to selectively etch and remove the aluminum sheet 4 alone serving as the removable layer 3 from the conductive substrate. As a result, there was obtained, as shown in FIG. 6*d*, a master 20 which had raised non-conductive portions 9 having projections from the surface of the stainless steel sheet 2 of the conductive substrate 1.

The thus obtained master 20 was further subjected to electrodeposition in the same manner as in Example 1 to form an electrodeposition film 11, followed by separation of the electrodeposition film 11 from the master 20 to obtain a metal sheet 13 having fine holes 12 in the same manner as in Example 1. This is particularly shown in FIGS. 6*e* and 6*f*.

Figure 6E:
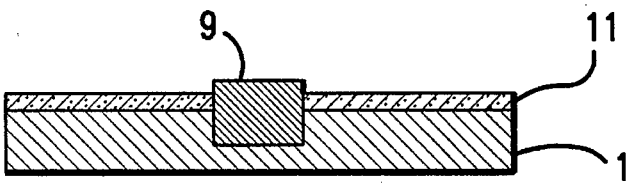
Figure 6F:
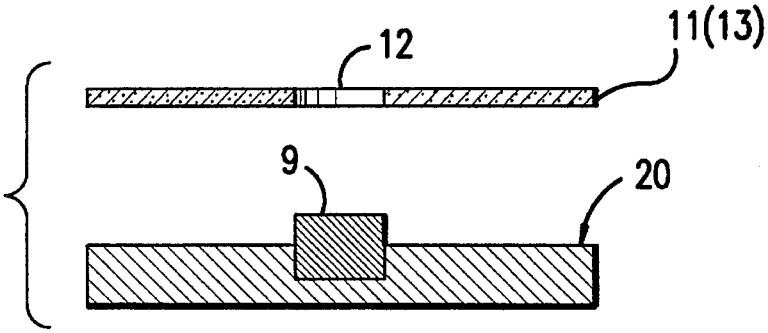
Figure 7A:
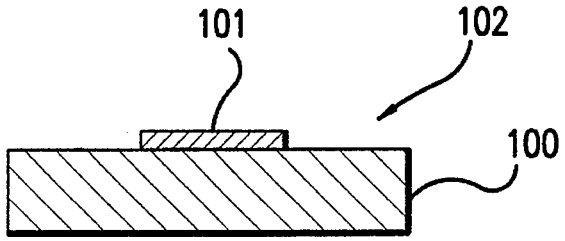
FIG.7a PRIOR ART
FIGS. 7*a* to 7*c* are, respectively, illustrative views showing main steps of a known fabrication method.
Figure 7B:
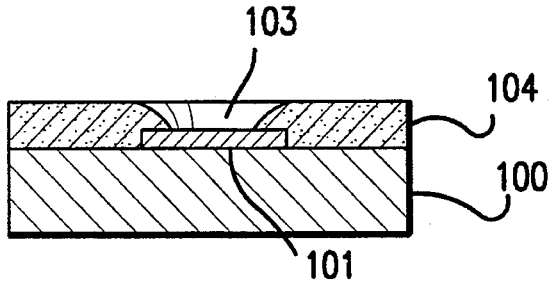
FIG.7b PRIOR ART
Figure 7C:
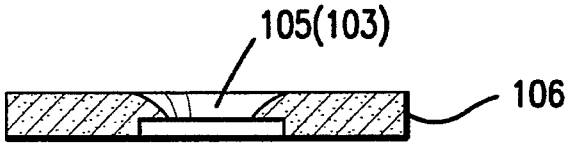
FIG.7c PRIOR ART
Figure 8:
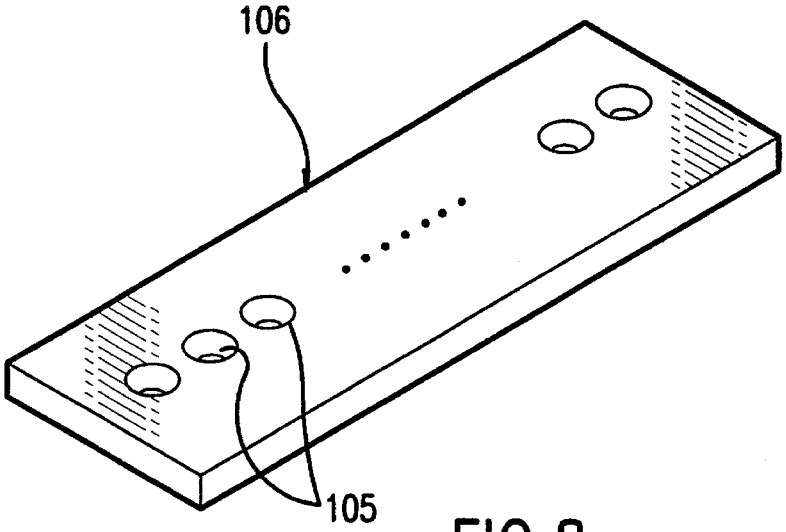
FIG.8 PRIOR ART
FIG. 8 is a perspective view showing a metal sheet having fine holes obtained according to the known fabrication method.
Figure 9A:
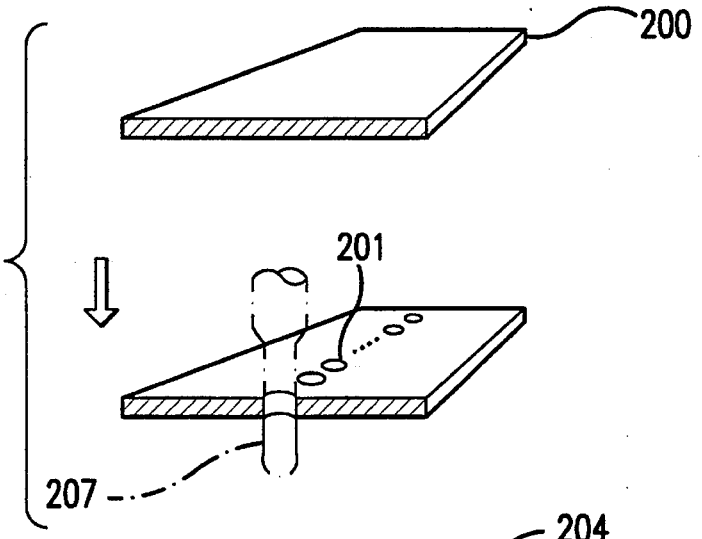
FIG.9a PRIOR ART
FIGS. 9*a* to 9*c* are, respectively, illustrative views showing main steps of another known fabrication method.
Figure 9B:
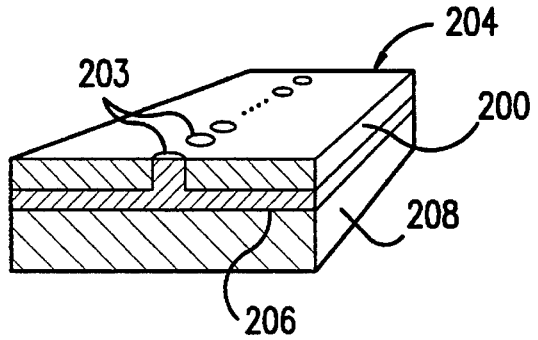
FIG.9b PRIOR ART
Figure 9C:
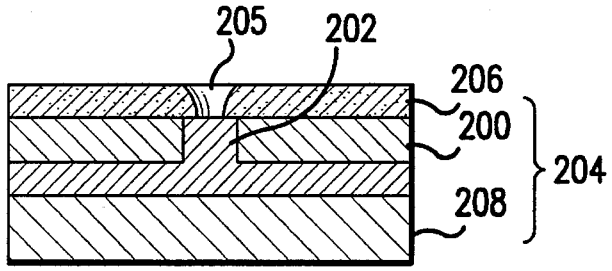
FIG.9c PRIOR ART
Figure 10:
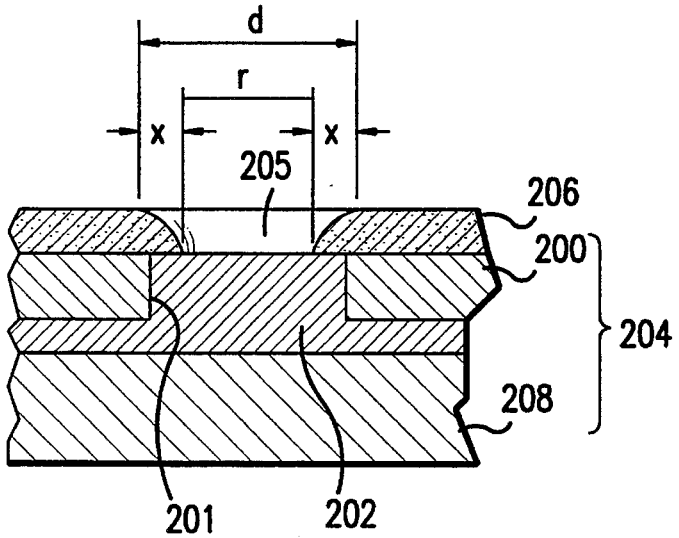
FIG.10 PRIOR ART
FIG. 10 is an illustrative view showing the state of a fine hole formed by the method of FIG. 9.

In this example, the electrodeposition film 11 is formed as deposited about the side surfaces of each projection of the raised non-conductive portions 9 as shown in FIG. 6*e*. The resultant metal sheet 13 has fine holes 12 whose diameter is invariably accorded with the diameter of the projections of the conductive portions. Thus, a number of the metal sheets 13 having the fine holes 12 which are free of any significant variation in the dimensional accuracy can be fabricated using the same master.

In the foregoing examples 1 to 4, although there is used as the conductive substrate 1 a master which has a double-layer structure including a layer capable of being removed by selective etching, the substrate 1 may consist of a master which has a double-layer structure including a releasable layer. In the latter case, the etching treatment for removing the removable layer through selective etching is not necessary. The master can be formed by a simple procedure wherein the removable layer is removed by release separation.

The through-holes or recesses may be formed in the conductive substrate 1 not only by the discharge machining or etching process as shown in the examples, but also by micro punching, drilling, electron beam irradiation techniques.

As will be apparent from the foregoing, according to the method of the invention, the fine holes of the resultant metal sheet have diameter and inner shape thereof which are according with those of the projections of the raised non-conductive portions. Thus, they can be invariably formed in a high accuracy without suffering any influence of the electrodeposition state. For setting the pitch between adjacent holes, it is not necessary to take into account the length of the overlap of the electrodeposition film as in the prior art methods, no limitation of the thickness of the electrodeposition film is placed on the formation density of the fine holes, ensuring a desired high formation density of the holes.

Using a repeatedly usable master, there can be efficiently mass-produced metal members having highly accurate fine holes. Since the raised non-conductive portions of the master are fixedly deposited on the conductive substrate, any non-conductive material for the non-conductive portions is not left within the fine holes at the time of separation of the electrodeposition film.

What is claimed is:

1. A method for fabricating a metal member having a plurality of fine holes, the method comprising the steps of:

forming a repeatedly usable master which includes a conductive substrate and non-conductive portions used to form fine holes and integrally combined with the conductive substrate;

forming an electrodeposition film by subjecting one side of the master to electrodeposition to form an electrodeposition film which has a plurality of non-electrodeposited holes corresponding in position to the non-conductive portions;

and separating the electrodeposition film from the master to obtain a metal member having the multitude of fine holes, wherein the non-conductive portions of the master, respectively, consist of raised non-conductive portions each having a projection from the surface of the conductive substrate and the electrodeposition is so performed that the electrodeposition film is deposited about individual projections, said conductive substrate having a double-layer structure including a removable layer, the master being created by making a plurality of through-holes in the conductive substrate, filling a non-conductive material in the respective through-holes, and removing the removable layer from said conductive substrate thereby forming the individual projections from the respective through-holes.

2. A method according to claim 1, wherein said removable layer is made of a metal which is removable by selective etching.

3. A method according to claim 1, wherein said through-holes are formed by discharge machining or etching.

4. A method according to claim 1, further comprising applying a non-conductive material to individual projections so that the thus applied non-conductive material covers the individual projections therewith after formation of the electrodeposition film, and subjecting the resulting master to further electrodeposition whereby a thicker metal member is obtained.

5. A method according to claim 1, wherein each projection is convergently tapered.

6. A method for fabricating a metal member having a plurality of fine holes, the method comprising the steps of:

forming a repeatedly usable master which includes a conductive substrate and non-conductive portions used to form fine holes and integrally combined with the conductive substrate;

forming an electrodeposition film by subjecting one side of the master to electrodeposition to form an electrodeposition film which has a plurality of non-electrodeposited holes corresponding in position to the non-conductive portions;

and separating the electrodeposition film from the master to obtain a metal member having the multitude of fine holes, wherein the non-conductive portions of the master, respectively, consist of raised non-conductive portions each having a projection from the surface of the conductive substrate and the electrodeposition is so performed that the electrodeposition film is deposited about individual projections, said conductive substrate having a double-layer structure including a removable layer, the master being created by forming recesses from the side of said removable layer in such a way that each recess has a depth larger than a thickness of said removable layer, filling a non-conductive material in the respective recesses, and removing the removable layer from said conductive substrate to form the individual projections as the non-conductive portions.

7. A method according to claim 6, wherein said through-holes are formed by discharge machining or etching.

8. A method according to claim 6, further comprising applying a non-conductive material to individual projections so that the thus applied non-conductive material covers the individual projections therewith after formation of the electrodeposition film, and subjecting the resulting master to further electrodeposition whereby a thicker metal member is obtained.

9. A method according to claim 6, wherein each projection is convergently tapered.

10. A method for fabricating a metal member having a plurality of fine holes, the method comprising the steps of:

forming a repeatedly usable master which includes a conductive substrate having a plurality of holes;

providing a non-conductive layer on one surface of the conductive substrate with non-conductive portions projecting from the non-conductive layer through the plurality of holes in the conductive substrate and projecting above an opposite surface of the conductive substrate, heights of the non-conductive portions projecting from the opposite surface of the conductive substrate being longer than a thickness of the metal member to be fabricated;

forming an electrodeposition film by subjecting the opposite surface of the conductive substrate to electrodeposition to form an electrodeposition film on the opposite surface of the conductive substrate having defined therein a plurality of non-electrodeposited holes corresponding in position to the non-conductive portions projecting from the opposite surface of the conductive substrate; and separating the electrodeposition film from the master to obtain the metal member having the plurality of fine holes.

* * * * *